United States Patent [19]

Ury

[11] Patent Number: 4,512,561

[45] Date of Patent: Apr. 23, 1985

[54] FOLDER UNIT WITH MEANS FOR SIMULTANEOUS PHASE SHIFTING OF FRONT AND REAR SPIRAL SETS

[75] Inventor: Frank Ury, St. Croix Falls, Wis.

[73] Assignee: Brandtjen & Kluge, Inc., St. Croix Falls, Wis.

[21] Appl. No.: 610,503

[22] Filed: May 15, 1984

[51] Int. Cl.[3] ..... B41L 1/30

[52] U.S. Cl. ..... 270/40; 493/430; 493/433

[58] Field of Search ..... 270/40–41; 493/405, 416, 417, 419–421, 424, 430, 433, 442

[56] References Cited

U.S. PATENT DOCUMENTS

| | | | |
|---|---|---|---|
| 790,833 | 5/1905 | Harris . | |
| 957,763 | 5/1910 | Gaeth . | |
| 1,543,597 | 6/1925 | Brautigam . | |
| 3,038,718 | 6/1962 | Balsam | 270/40 |
| 3,152,742 | 10/1964 | Wright . | |
| 3,473,410 | 10/1969 | Kraft . | |
| 3,563,104 | 2/1971 | Schuster . | |
| 3,640,521 | 2/1972 | Hutley | 493/416 |
| 3,762,698 | 10/1973 | Thomas . | |
| 4,204,669 | 5/1980 | Nystrand | 493/430 |
| 4,205,836 | 6/1980 | Nystrand | 493/430 |

OTHER PUBLICATIONS

Operating Manual, Didde Graphic Systems Corp., 1981.

*Primary Examiner*—E. H. Eickholt

*Attorney, Agent, or Firm*—Peterson, Wicks, Nemer & Kamrath

[57] ABSTRACT

A folder unit according to the teachings of the preferred embodiment of the present invention is shown as including front and rear sets of spirals for folding a continuous web of paper. The spirals are driven by first and second shafts whose ends extend through elongated slots formed in the side plates of the unit. A third drive shaft is further provided rotatably related to the first and second shafts and including a slideable helical gear. When the helical gear is slid on the third drive shaft, the third drive shaft is forced to rotate due to the helix of the helical gears simultaneously changing the rotational position of the spiral sets with respect to the other folder unit components. To prevent the spiral gear boxes from rotating with the first and second shafts, anti-rotation bars are provided which also extend through the elongated slots of the side plates. Furthermore, paper guides are secured to the rear anti-rotation bar eliminating the necessity of their attachment to the side plates of the folder unit. Additionally, the folder unit of the present invention includes novel kicker brushes removeably secured to the drive shafts and having bristles extending 180 degrees around their periphery allowing the diameter edge of the bristles to be parallel to the paper chute when the paper chute is midway between the sets.

19 Claims, 9 Drawing Figures

FOLDER UNIT WITH MEANS FOR SIMULTANEOUS PHASE SHIFTING OF FRONT AND REAR SPIRAL SETS

The present invention relates generally to folder units.

With the increasing use of folded paper for web printing, computer, word processing, and other high speed printing applications, a need has arisen for folder units for folding a continuous web of paper which are simple to manufacture, economical, easy to set up and operate, and efficient. Further, the ability to fine tune the folding spirals when the folding unit is operating is highly desirable.

SUMMARY

The present invention solves this need by providing, in the preferred embodiment, an improved method for driving the shafts of the front and rear spiral sets together and for allowing the simultaneous phase shifting of the front and rear spiral sets. Specifically, a drive shaft is provided extending between and rotatably related to the shafts of the front and rear spiral sets. A helical drive gear is rotatably related to and slideable with respect to the drive shaft. By sliding the helical gear with respect to the drive shaft, the drive shaft is forced to rotate due to the helix of the helical gears simultaneously changing the rotational position of the front and rear sets of spirals with respect to the position of the other components of the folder unit.

The present invention solves this need by providing, in the preferred embodiment, an improved method for slideably mounting the shafts of the front and rear spirals for changing the spacing therebetween. Specifically, slide bars are provided on the side plates of the folder unit below and parallel to elongated slots through which the ends of the shafts of the front and rear spirals extend. The members which rotatably mount the shafts include a flat bottom surface for sliding upon the slide bars for support thereby. Thus, the elongated slots of the slide plates are not required to be milled openings but rather are of the clearance variety greatly reducing the cost of the slide plate construction.

The present invention solves this need by providing, in the preferred embodiment, an improved method for kicking the paper into the spirals which can be rotatably positioned by relatively unskilled personnel. Specifically, brushes are provided including a two-piece hub allowing its removal or repositioning on the spiral drive shafts. The brushes include bristles which extend around 180 degrees of their periphery. The brushes can then be aligned such that the diameter edge of the bristles is parallel to the paper chute when it is located midway between the front and rear spiral sets.

The present invention solves this need by providing, in the preferred embodiment, an improved method for preventing the spirals from rotating with the first and second shafts. Specifically, anti-rotation bars are provided having their ends passing through elongated slots of the folder unit side plates. The anti-rotation bars are slideably mounted within the gear boxes which rotatably relate the spiral sets to the first and second shafts.

The present invention solves this need by providing, in the preferred embodiment, an improved method for mounting the paper guides to the folder unit. Specifically, the paper guides include a U-shaped member having a first leg which directs the paper web and a third leg which is connected to a member which is slideably, rotatably, and removably mounted to the rear anti-rotation bar.

The present invention solves this need by providing, in the preferred embodiment, an improved method for initially orientating the spirals with respect to each other and the other folder unit components. Specifically, a hollow tube is rotatably related to the spiral drive shafts. A bolt extends through the hollow tube and is threadably secured to the hub of the spiral blades. Thus, the spirals can be orientated by loosening the bolt, repositioning the spiral blades, and tightening the bolt to rotatably relate the spiral blades with the hollow tube.

Thus, it is an object of the present invention to provide a novel folder unit.

It is also an object of this invention to provide such a novel folder unit including novel means for phase shifting the spirals.

It is also an object of this invention to provide such a novel folder unit allowing phase shifting of the spirals while the folder unit is operating.

It is also an object of this invention to provide such a novel folder unit which can be easily and rapidly set up by relatively unskilled technicians.

It is also an object of this invention to provide such a novel folder unit allowing longitudinal positioning of the spiral sets without requiring milled openings in the folder unit side plates.

It is also an object of this invention to provide such a novel folder unit including novel kicker brushes.

It is also an object of this invention to provide such a novel folder unit allowing adjustment of the front and rear spiral sets simultaneously.

It is also an object of this invention to provide such a novel folder unit including novel means for preventing the spirals from rotating with the spiral drive shafts.

It is also an object of this invention to provide such a novel folder unit including novel means for mounting the paper guides to the folder unit.

It is also an object of this invention to provide such a novel folder unit for initially orientating the spirals with respect to each other and the other folder unit components.

It is also an object of this invention to provide such a novel folder unit which is of a simple design, is easy to manufacture, assemble, repair, and operate, maximizes material, and is efficient.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
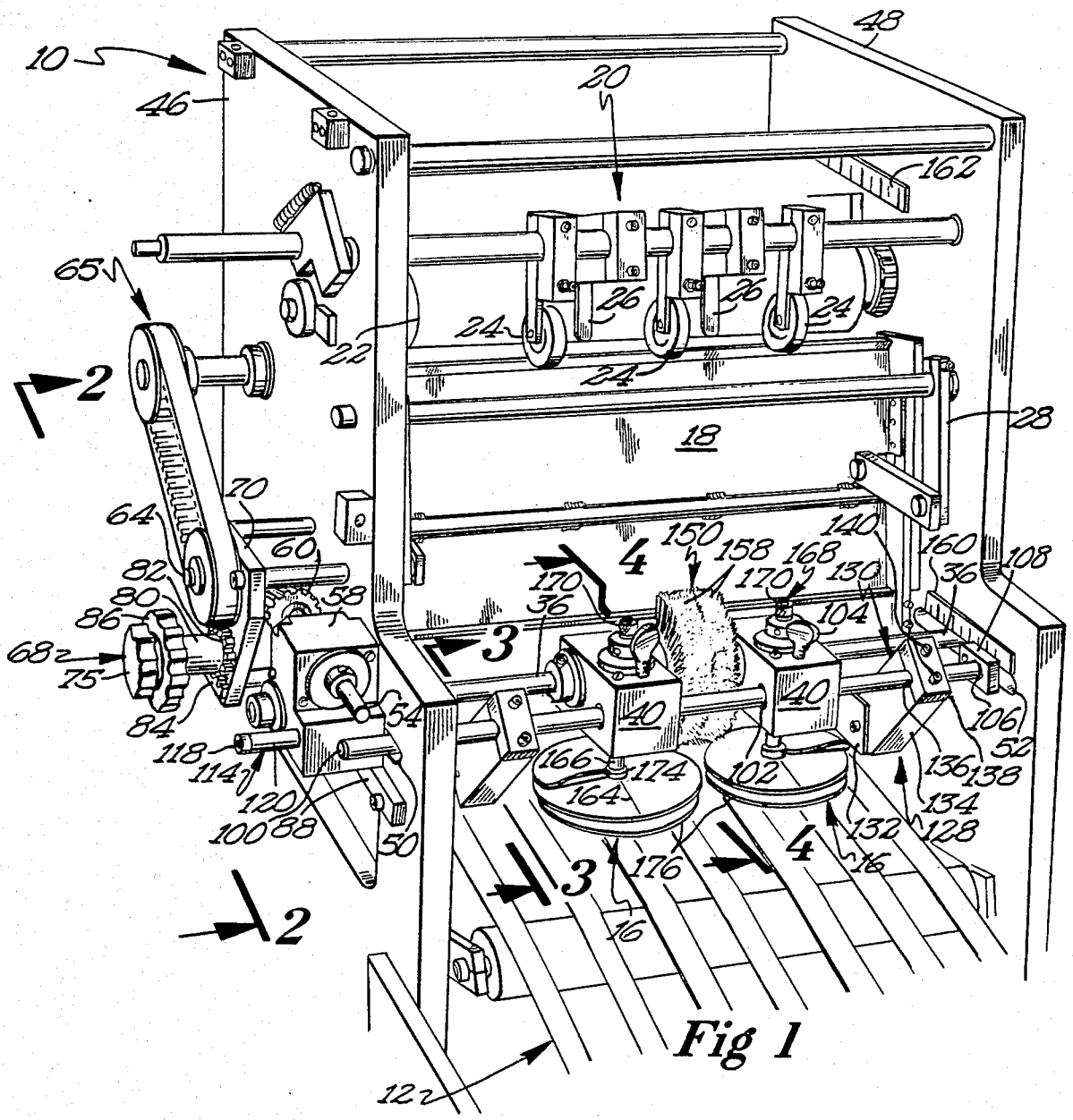
FIG. 1 shows a perspective view of a folder unit constructed according to the teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "front", "rear", "bottom", "horizontal", "lateral", "longitudinal", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A folder unit according to the teachings of the present invention is generally shown in the drawings and generally designated 10. Unit 10 generally includes a creeper table 12 located below front and rear sets 14 and 16 of vertical spirals for folding a web of paper, a paper chute 18 for directing paper into spirals 14 and 16, and suitable members 20 for delivering paper to the paper chute 18. Members 20 are shown in the preferred embodiment as including a drive wheel 22 around which the paper is wrapped, members 24 for keeping the paper engaged with the drive wheel 22 shown in its preferred form as spaced press rollers, and leaf springs 26 abutting against the web of paper for preventing the paper from being pushed backward up paper chute 18. Members 20 may further include a tractor or pin wheel feed for insuring even feed of the web of paper and the necessary idler rollers for delivering the paper to the tractor or pin wheel feed and/or drive wheel 22.

Paper chute 18 is pivotable about a horizontal lateral axis generally perpendicular to the paper feed direction by linkage arms 28 between a first position for directing the paper towards the front set of spirals 14 and a second position for directing the paper towards the rear set of spirals 16. In the most preferred form, paper chute 18 is in a vertical position when it is midway between the front and rear spiral sets 14 and 16.

Unit 10 further includes front and rear horizontal shafts 34 and 36 which are generally perpendicular to the paper feed direction and parallel to each other. Front shaft 34 drives front set of spirals 14 through right angle gear boxes 38 and rear shaft 36 drives rear set of spirals 16 through right angle gear boxes 40. Thus, spirals 16 and 18 are rotated about vertical axes which are perpendicular to the paper feed direction. It can then be appreciated that front and rear sets 14 and 16 of spirals can include two or more spirals.

The opposite ends of shaft 34 extend through horizontally orientated, longitudinal, elongated slots 42 and 44 formed in the first and second side plates 46 and 48 of unit 10, respectively. Likewise, the opposite ends of shaft 36 extend through horizontally orientated, longitudinal, elongated slots 50 and 52 formed in side plates 46 and 48 of unit 10, respectively. Slots 42, 44, 50 and 52 are elongated in the direction of the paper web feed.

Unit 10 according to the teachings of the present invention further includes a horizontal, longitudinal side drive shaft 54 which is generally parallel to the direction of the paper web feed and generally perpendicular to shafts 34 and 36. Shafts 34 and 36 are in driven relationship with shaft 54 on opposite ends thereof by right angle gear boxes 56 and 58, respectively. In the preferred embodiment, gear boxes 56 and 58 are slideable along shaft 54 to allow positioning sets 14 and 16 of spirals closer together or further apart in a longitudinal direction or in other words for changing the spacing therebetween.

For purposes of driving side drive shaft 54, a first helical gear 60 is provided in a nonrotatable relation with shaft 54 in gearing relation with a second helical gear 62. Helical gear 62 in the preferred embodiment is rotatable with horizontal, lateral shaft 64 which is generally perpendicular to shaft 54 and the paper feed direction. Suitable provisions 65 such as the bolt and pulley arrangement connected to a further drive shaft as shown in the drawings of the preferred embodiment of the present invention are provided for driving shaft 64 with drive wheel 22 and the pivoting mechanism for paper chute 18.

For purposes of controlling the phase or fine tuning the orientation of spiral sets 14 and 16 according to the teachings of the present invention, helical gear 60 is slideable upon shaft 54 by a shifting yoke 66. In the preferred embodiment, a shifting mechanism 68 is provided for sliding yoke 66 along shaft 54 and thus shifting helical gear 60 thereon. In its most preferred form, mechanism 68 includes a plate 70 held in a spaced parallel relation to side plate 46. In its most preferred form, shaft 64 is rotatably mounted in and between plate 70 and side plate 46. Plate 70 includes a horizontal, longitudinally orientated, elongated slot 72. A shifting bolt 74 is provided having a knob end 75 and a shank 76 threaded into yoke 66. A cylindrical spacer 78 is provided for abutment between knob 74 and plate 70 around elongated slot 72. Thus, in a loosened condition, shank 76 is free to travel in elongated slot 72 and due to its threaded relation to yoke 66, yoke 66 and gear 60 can be slid on shaft 54 by longitudinal movement of bolt 74 within elongated slot 72. However, in a tightened relation, spacer 78 abuts between plate 70 and knob 74 preventing relative movement therebetween and thus preventing longitudinal movement of yoke 66 and gear 60 on shaft 54.

For purposes of allowing fine tuning or adjustment of gear 60 and yoke 66, unit 10 further includes a cylindrical portion 80 located on and rotatable about spacer 78. A pinion gear 82 is formed on portion 80 at its end adjacent plate 70 which is in gearing relation with a rack gear 84 mounted on plate 70. A knob 86 is further provided on the opposite end of portion 80. Thus, when bolt 74 is in a loosened condition, shank 76 can be longitudinally moved within slot 72 by rotating knob 86 causing cylindrical portion 80 and shank 76 located therein to travel longitudinally due to the gearing relation of gears 82 and 84. When bolt 74 is tightened by knob 75 preventing longitudinal movement due to the abutting relation of spacer 78, cylindrical portion 80 is also locked due to the gearing relation of gears 82 and 84.

Figure 5:
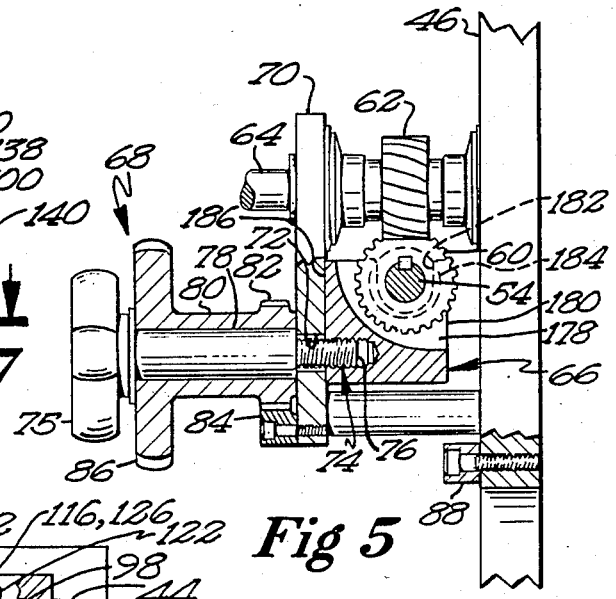
FIG. 5 shows a partial, cross-sectional view of the folder unit of FIG. 1 according to section line 5—5 of FIG. 2.
Figure 9:
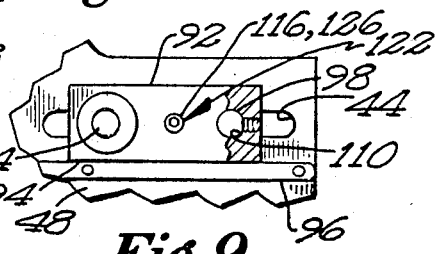
FIG. 9 shows a partial, side view of the folder unit of FIG. 1.
Figure 4:
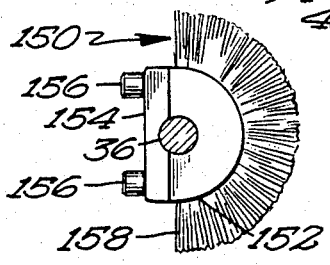
FIG. 4 shows a cross-sectional view of the folder unit of FIG. 1 according to section line 4—4 of FIG. 1.
Figure 7:
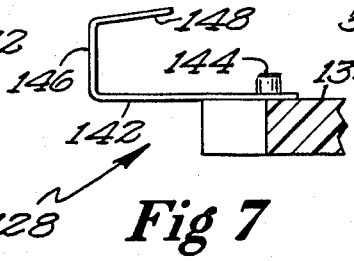
FIG. 7 shows a partial, cross-sectional view of the folder unit of FIG. 1 according to section line 7—7 of FIG. 3.
Figure 6:
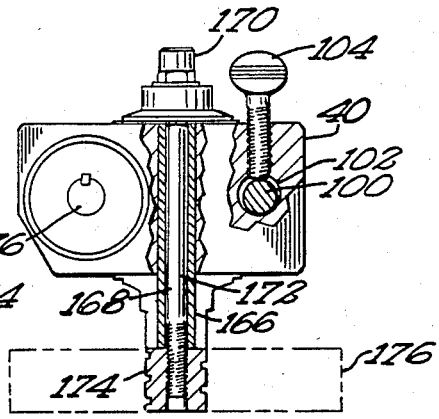
FIG. 6 shows a partial, cross-sectional view of a spiral and its gear box of the folder unit of FIG. 1.

Yoke 66 according to the teachings of the present invention has a unique construction in its most preferred form as best seen in FIG. 5. Specifically, yoke 66 is formed from a block having a concave cutout portion 178 extending into the upper, inner corner of the block midway between its ends. Cutout portion 178 has a size and shape for receipt of gear 60. First and second legs 180 are formed in the block defined between the cutout portion 178 and the ends of the yoke block. Generally semi-circular depressions 182 are formed in legs 180 for receipt of bearings 184 for rotatably and slideably mounting shaft 54 to yoke 66. Bearings 184 abut with gear 60 on opposite sides thereof. The outer face 186 of the yoke block engages with and is slideable along plate 70. It can then be noted that yoke 66 constructed according to the teachings of the present invention results in several advantages. Specifically, yoke 66 is of a very strong design which can be easily and economically manufactured. Additionally, due to the large abutment area of face 186 and plate 70, accurate positioning of gear 60 on shaft 54 can be obtained and maintained.

For purposes of allowing the slideable mounting of shafts 34 and 36 between plates 46 and 48, a first slide bar 88 is provided located on side plate 46 beneath and parallel to slots 42 and 50. Gear boxes 56 and 58 which rotatably mount the ends of shafts 34 and 36 extending beyond side plate 46 include a generally horizontal bottom surface 90 for sliding on slide bar 88. The opposite ends of shafts 34 and 36 extending beyond side plate 48 are rotatably mounted in bearing blocks 92. Blocks 92 include a generally horizontal bottom surface 94 for sliding on a slide bar 96 located on side plate 48 beneath and parallel to slots 44 and 52.

For preventing gear boxes 38 and 40 from rotating with shafts 34 and 36, anti-rotation bars 98 and 100, respectively, are provided. Bars 98 and 100 are slideably received within apertures 102 formed in gear boxes 38 and 40 and can be locked therein by suitable locking devices 104 such as lock bolts threadably received in gear boxes 56 and 58 and which abut with bars 98 and 100 within apertures 102. The first ends of bars 98 and 100 pass through slots 42 and 50 of side plate 46 and the second ends of bars 98 and 100 pass through slots 44 and 52 of side plate 48. The second ends of bars 98 and 100 pass through apertures 110 formed in slide blocks 92. Bars 98 and 100 can be locked in apertures 110 by suitable locking means such as set screws which are threaded into blocks 92 and abut bars 98 and 100 within apertures 110.

For purposes of locking shafts 34 and 36 in the desired longitudinal position, locking members 114 and 116 are provided. Specifically, in the preferred embodiment, arms 108 are provided located on the opposite side of the side plate 46 from gear boxes 56 and 58 and also located on the opposite side of side plate 48 from bearing blocks 92. Bars 98 and 100 pass through apertures 106 formed in arms 108. In the preferred embodiment, locking members 114 further include an extended bolt 118 which passes through gear boxes 56 and 58 and slots 42 and 50 and which are threaded into arms 108 and a cylindrical sleeve 120 located thereon. By tightening bolts 118, arm 108 is drawn against side plate 46 for capturing side plate 46 between arms 108 and gear boxes 56 and 58. In its most preferred form, bolts 118 also secure arms 108 to gear boxes 56 and 58. It should be noted that bars 98 and 100 could also pass directly through gear boxes 56 and 58 for anchoring purposes; however, the construction according to the teachings of the present invention allows gear boxes 56 and 58 to be of a smaller size than if bars 98 and 100 passed therethrough in a similar manner as bars 98 and 100 pass through gear boxes 38 and 40.

Likewise, locking members 114 further include an extended bolt 122 which passes through blocks 92 and slots 44 and 52 and which are threaded into arms 108 located on the opposite side of side plate 48 and a cylindrical sleeve 126 located thereon. By tightening bolts 122, arms 108 are drawn against side plate 48 for capturing side plate 48 between arm 108 and block 92. Sleeves 120 and 126 are provided to allow bolts 118 and 120 to extend through guards provided to the outside surface of side plates 46 and 48 to enclose the gears and other drive mechanism. Thus, shafts 34 and 36 can be positioned and locked without the necessity of removing the guards.

For purposes of preventing lateral movement of the paper web, paper guides 128 are provided secured to anti-rotation bar 100. In the preferred embodiment, guides 128 include a two-piece block member 130 and a generally U-shaped guide member 132. Block member 130 includes a first, elongated member 134 having a U-shaped depression 136 formed in one end thereof and a second, C-shaped member 138. Thus, bar 100 can be captured in depression 136 and C-shaped member 138 of block member 130 and held thereon by bolts 140 which passes through C-shaped member 138 and which are threaded into member 134. It can then be appreciated that block member 130 can be removed from bar 100 by removing bolts 140 and without the necessity of removing bar 100 from unit 10. Furthermore, block member 130 can be slid and/or rotated on bar 100 by loosening bolts 140 to allow guides 128 to be positioned according to the particular width of the paper being folded.

Figure 3:
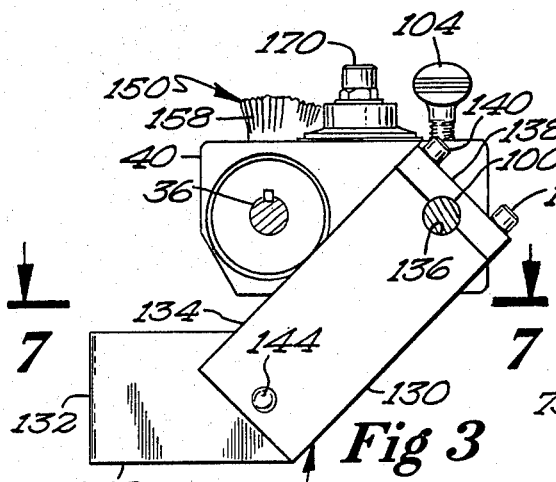
FIG. 3 shows a cross-sectional view of the folder unit of FIG. 1 according to section line 3—3 of FIG. 1.

U-shaped guide member 132 generally includes a first leg 142 connected by its first end to block member 130 such as by bolts 144, a second leg 146 connected by its first end to the second end of leg 142, and a third leg 148 connected by its first end to the second end of leg 146. In the preferred embodiment, leg 146 is generally perpendicular to leg 142 and leg 148 is connected at an angle slightly larger than 90 degrees in a direction away from leg 142. In the preferred form, guide member 132 is secured at an obtuse angle to block member 130 and in the preferred embodiment is secured at an angle in the range of 140 degrees as best seen in FIG. 3. Thus, if the paper becomes misaligned, the paper is directed by leg 148 to be positioned between the second free ends of leg 148 of guides 128.

It should then be noted that the paper guides must be positioned according to the width of the web of paper and the length of the folded papers or in other words the distance between the cross perforations of the paper web. Prior to the present invention, paper guides were mounted to the side plates of the folder unit. However, due to the provisions necessary for positioning the paper guides according to paper size, the mounting of paper guides was of a complicated construction and generally congested the folder unit. Paper guides 128 according to the present invention are mounted to anti-rotation bar 100 resulting in several advantages. First, congestion along side plates 46 and 48 is removed since paper guides are not mounted thereto. Further, since paper guides 128 can be rotated and slid on anti-rotation bar 100, adjustment for web paper width can be easily accomplished by simply positioning paper guides on anti-rotation bar 100 and not requiring the complicated construction of prior paper guides. Additionally, since paper guides 128 are mounted to anti-rotation bar 100, when rear spiral set 16 is moved longitudinally for different cross perforation spacing, paper guides 128 are moved with shaft 36 and anti-rotation bar 100. Thus, adjustment for different cross perforation spacing at paper guides occurs automatically with adjustment of spiral set 16. Therefore, paper guides 128 according to the teachings of the present invention is clearly advantageous over prior paper guides.

In the preferred embodiment, unit 10 further includes two-piece kicker brushes 150 including a first C-shaped member 152 and a second C-shaped member 154 removably attached to member 152 by bolts 156. Thus, shafts 34 and 36 can be captured between members 152 and 154 for rotatably relating brushes 150 with shafts 34 and 36. It can then be appreciated that brushes 150 can be removed from shafts 34 and 36 by removing bolts 156 and without the necessity of removing shafts 34 and 36 from unit 10. Furthermore, brushes 150 can be slid and/or rotated on shafts 34 and 36 by loosening bolts 156 for positioning. First member 152 includes bristles 158 which extend 180 degrees around the periphery of brushes 150. In operation, brushes 150 lay or force the paper on the flat area of spirals 14 and 16 where the cross perforations of the paper web are broken and the leading, upturned edge of spirals 14 and 16 captures it in the spiral blades as spirals 14 and 16 rotate.

Additionally, unit 10 according to the teachings of the present invention includes a novel spiral construction. Specifically, spirals 14 and 16 generally include a hollow, cylindrical tube 166 which passes through gear boxes 38 and 40 and which is rotatably related to shafts 34 and 36 thereby. Bolt 168 is further provided having an enlarged head 170 and an elongated shank 172 which extends through tube 166. Head 170 may include a knurled edge for grasping by the fingers of the user and include provisions for grasping by a wrench such as an allen-type depression formed in head 170 of bolt 168. The hub 174 of the spiral blades 176 is threadably mounted on the end of shank 172 of bolt 168 and abuts with the opposite end of tube 166. Thus, by loosening bolt 168, the orientation of spirals 14 and 16 with respect to tube 166 and shafts 34 and 36 can be changed. When in their desired position, blades 176 can be held with one hand while the head 170 is grasped by the other hand or by a suitable wrench to tighten bolt 168. When bolt 168 is tight, head 170 and hub 174 abut against the opposite ends of tube 166 capturing it therebetween. Thus, head 170, bolt 168, shank 172, hub 174 and blades 176 will be held in a nonrotatable condition with tube 166 and will be driven therewith by shafts 34 and 36.

Now that the construction of unit 10 according to the preferred embodiment has been set forth, the operation, advantages, and subtle features of the present invention can be set forth and appreciated. For example, the use of slide bars 88 and 96 upon which flat bottom surfaces 90 and 94 of gear boxes 56 and 58 and blocks 92 slide eliminates the need of milled openings in side plates 46 and 48. Thus, since slots 42, 44, 50, and 52 are of a clearance variety rather than of the milled variety, side plates 46 and 48 can be manufactured at a greatly lesser cost by less skilled technicians than side plates utilized in prior folder units utilizing milled openings.

In setting up unit 10 according to the teachings of the present invention, front and rear spiral sets 14 and 16 may be spaced according to the distances between the cross perforations of the paper desired to be folded. Thus, bolts 118 and 122 may be loosened allowing gear boxes 56 and 58 and blocks 92 to be slid upon slide bars 88 and 96 until sets 14 and 16 of spirals are located at the desired position. Towards that end, reference scales 160 are positioned on the inside surface of side plate 46 for interaction with arm 108. Thus, by visually observing the position of arm 108 in regard to reference scale 160, spiral sets 14 and 16 can be easily and rapidly positioned. It should then be appreciated that the placement of spiral sets 14 and 16 can be accomplished by relatively unskilled technicians whereas prior folder units required skilled personnel. Therefore, the structure of the present folder unit 10 according to the teachings of the present invention including reference scales 160 is less costly to operate due to the lesser skill required in adjusting for paper size.

The cross perforations of the web of paper may then be lined up with a second reference scale 162 located above drive wheel 22. Specifically, the cross perforations of the paper may be located on drive wheel 22 according to the particular distance between the cross perforations of the paper web desired to be folded. Again, it should be appreciated that the use of reference scale 162 allows relatively unskilled technicians to set up folder unit 10 according to the teachings of the present invention including reference scale 162.

Thereafter, the gearing or drive relation between drive wheel 22 and chute 18 can be temporarily disconnected. Chute 18 can then be positioned in a vertical position. At that time, the gearing or other drive connection between drive wheel 22 and the pivoting mechanism for chute 18 can be reconnected such that rotation of drive wheel 22 causes chute 18 to pivot about its horizontal axis. It should be appeciated that due to the drive connection 65 between the chute pivoting mechanism and shaft 64, front and rear shafts 34 and 36, spiral sets 14 and 16, and brushes 150 are simultaneously rotated as the chute is manually pivoted to a vertical position with the gearing between the drive wheel and the chute pivoting mechanism disconnected.

Figure 8:
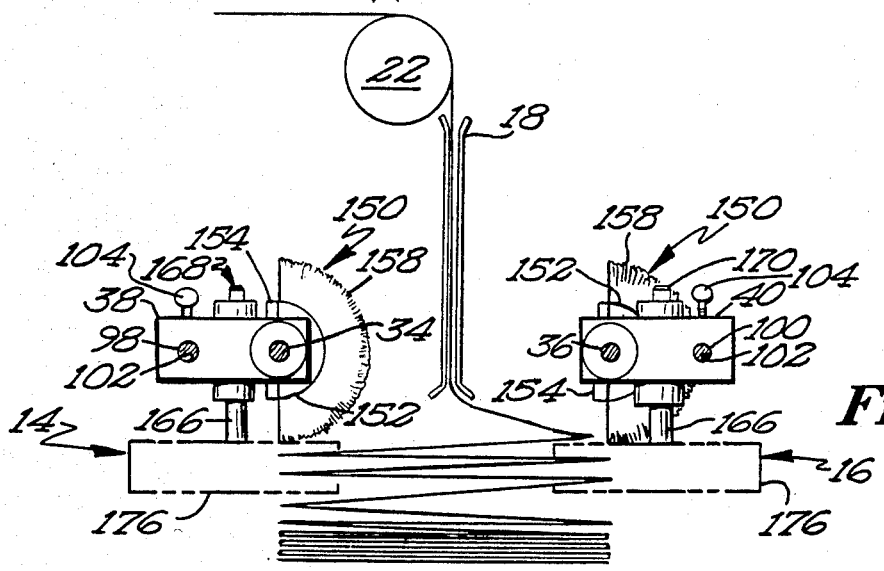
FIG. 8 shows a diagrammatic, side view of the folder unit of FIG. 1.
Figure 2:
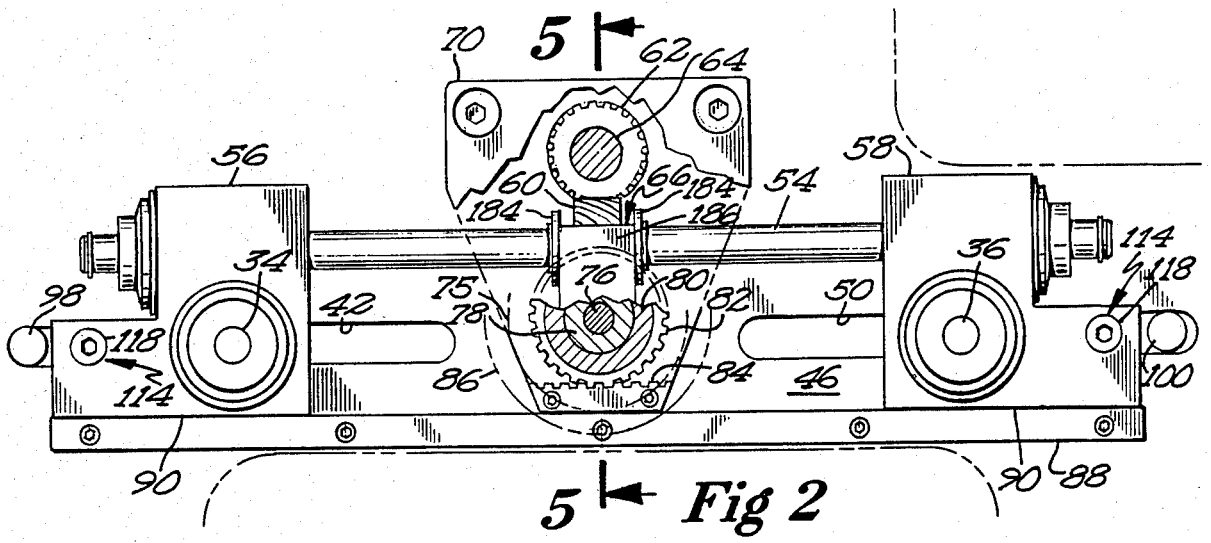
FIG. 2 shows a cross-sectional view of the folder unit of FIG. 1 according to section line 2—2 of FIG. 1.

After chute 18 is in a vertical position, brushes 150 may then be positioned such that the diameter edge of bristles 158 is in a vertical condition, with bristles 158 extending in the direction of movement of chute 18 as shown in FIG. 8. This adjustment can be accomplished by loosening bolts 156 and rotating brushes 150 about shafts 34 and 36 until they are in the desired position. At which time, bolts 156 can again be tightened holding brushes 150 in the desired nonrotatable condition with shafts 34 and 36. It can again be appreciated that positioning of chute 18 and brushes 150 can be accomplished by relatively unskilled technicians in the set up of folder unit 10 according to the teachings of the present invention.

Additionally, it should be appreciated that brushes 150 of the present invention are advantageous for other reasons. For example, brushes 150 are mounted directly to shafts 34 and 36 which drive spirals 14 and 16 and thus are rotatably related to spirals 14 and 16. The orientation of brushes 150 to shafts 34 and 36 can be adjusted by simply loosening bolts 156 and rotating brushes 150 to the desired position. Thus, no separate or complicated timing mechanisms are required for placing brushes 150 in phase with spirals 14 and 16.

Next, the rotatable position or phase of spiral sets 14 and 16 can be varied. Bolt 74 may be loosened by turning knob 76. Next, knob 86 may be rotated for rotating cylindrical portion 80 on spacer 78 to drive pinion gear 82 along rack gear 84 for purposes of shifting yoke 66 and gear 60 along side drive shaft 54. Gear 82 should then be positioned midway between the ends of rack gear 84 at which time bolt 74 may be tightened by turning knob 76. Spirals 14 and 16 can then be positioned at the desired rotational condition with respect to each other and the other components of folder unit 10. Towards that end, score lines 164 are formed on the spirals of sets 14 and 16. Bolts 168 are loosened by holding blades 176 of spirals 14 and 16 and turning heads 170. Initially, spiral sets 14 and 16 can be rotated until score lines 164 of spiral sets 14 and 16 are located in a longitudinal condition and generally parallel to each other. At that time, bolt 168 may be tightened by turning head 170 while holding blades 176 to thus capture tube 166 between head 170 and hub 174 at the desired spiral orientation. It can again be appreciated that the orientation of spiral sets 14 and 16 of unit 10 according to the teachings of the present invention can be easily accomplished by a relatively unskilled technician utilizing score lines 164 of the present invention.

Thereafter, unit 10 may then be operated to begin folding the web of paper. During operation of spiral sets 14 and 16, the condition of the folded paper can be observed. Fine adjustment or tuning of spiral sets 14 and 16 may then be desired. Specifically, while folder unit 10 is operating folding the web of paper, bolt 74 may be loosened by turning knob 75. At that time, knob 86 can be rotated turning pinion gear 82 in gearing relation with rack gear 84 for shifting yoke 66 and gear 60 on side drive shaft 54. Thus, due to the helix of helical gears 60 and 62, the side drive shaft 54 is forced to rotate changing the relative rotational positions between shaft 64 and drive shaft 54 and thus changing the relative rotational position of spiral sets 14 and 16. Furthermore, it can be appreciated that due to the provisions of pinion gear 82 and rack gear 84, very fine adjustment or tuning of spiral sets 14 and 16 can be accomplished. Likewise, it can be appreciated that due to the positioning of gear 82 midway between the ends of rack gear 84 during initial orientation of spirals 14 and 16 as set forth hereinbefore, fine adjustment can be made either to advance or retard the spiral orientation. After spiral sets 14 and 16 have been properly phased, bolt 74 may again be tightened utilizing knob 75.

It should then be appreciated that the present invention is especially advantageous in that fine adjustment of spiral sets 14 and 16 can be accomplished while folder unit 10 is operating. Therefore, adjustment can be accomplished by relatively unskilled technicians. Prior to the present invention, it was necessary to stop operation of the folding unit for providing fine adjustment of the spiral orientations. Thus, the degree of skill necessary for adjusting prior folder units is considerably greater than that required by the present invention. Furthermore, in addition to the lesser skill required in adjusting folder unit 10 of the present invention, the output of folder unit 10 is increased since the amount of time required in the fine adjustment of the spiral sets 14 and 16 is greatly reduced than when it was necessary to stop and start the prior folder units.

It should then be noted that the present invention provides simultaneous adjustment of front and rear spiral sets 14 and 16 due to the provision of a single drive shaft 54 upon which shifting gear 60 is located. Thus, the provision of a single side drive shaft 54 is clearly advantageous in that separate adjustment controls are not required as was done in prior folder units.

Now that the basic teachings of the present invention have been explained, many extensions and variations will be obvious to one having ordinary skill in the art. For example, folder unit 10 of the preferred embodiment of the present invention as shown and described includes many innovative features which can be utilized separately or in numerous combinations. It is then believed that the combination of these features in a single unit is particularly advantageous; however, utilization of selected features can be made in other types of folder units according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. In a folder unit for folding a continuous web of paper having cross perforations including a front set of spirals, a first shaft having a first end and a second end, first gear boxes for rotatably relating the front set of spirals to the first shaft, a rear set of spirals, a second shaft having a first end and a second end, with the first shaft being in a parallel spaced relation to the second shaft, second gear boxes for rotatably relating the rear set of spirals to the second shaft, a paper chute pivotal between a first position for directing the paper web towards the front set of spirals and a second position for directing the paper web towards the rear set of spirals, a first drive gear in a rotatable relation with the position of the paper chute, a first side plate, a second side plate, with the first end of the first shaft extending through a first elongated slot formed in the first side plate and with the second end of the first shaft extending through a second elongated slot formed in the second side plate, with the first end of the second shaft extending through a third elongated slot formed in the first side plate and the second end of the second shaft extending through a fourth elongated slot formed in the second side plate, wherein the improvement comprises means for driving the first and second shafts together and for allowing the simultaneous phase shifting of the first and second shafts with the position of the paper chute, with the phase shifting and driving means comprising, in combination: a third drive shaft extending between the first and second shafts; third gear box for rotatably relating the third drive shaft and the first shaft and for rotatably mounting the first end of the first shaft; fourth gear box for rotatably relating the third drive shaft and the second shaft and for rotatably mounting the first end of the second shaft; a second drive gear rotatably related to but slideable with respect to the third drive shaft; with the first and second drive gears being helical gears and in gearing relation together; and means for sliding the second drive gear with respect to the third drive shaft forcing the third drive shaft to rotate and change its rotational position with respect to the first drive gear due to the helix of the first and second helical drive gears causing the rotational position of the front and rear sets of spirals to simultaneously change with respect to the position of the paper chute due to the rotatably relating means of the third drive shaft with the first and second shafts; wherein the improvement further comprises means for changing the spacing between the first and second shafts, with the spacing changing means comprising, in combination: a first slide bar secured to the first side plate beneath and generally parallel to the first and third elongated slots; a second slide bar secured to the second side plate beneath and generally parallel to the second and fourth elongated slots; with the third gear box having a bottom surface for sliding on the first slide bar, with the fourth gear box having a bottom surface for sliding on the first slide bar; means having a bottom surface for sliding on the second slide bar for rotatably mounting the second end of the first shaft, and means having a bottom surface for sliding on the second slide bar for rotatably mounting the second end of the second shaft, wherein the first and second shafts are supported by the third and fourth gear boxes and the rotatably mounting means slideably supported on the first and second slide bars and not by the elongated slots allowing the elongated slot to be of the clearance variety and not milled in the side plates reducing the manufacturing costs of the side plates and the overall folder unit; wherein the improvement further comprises an improved means for preventing the spirals from rotating with the first and second shafts comprising, in combination: a first anti-rotation bar having a first end and a second end; a second anti-rotation bar having a first end and a second end, with the first and second anti-rotation bars being in a spaced, parallel relation to each other and the first and second shafts, with the first and second anti-rotation bars and the first and second shafts lying in a single plane, with the first end of the first anti-rotation bar extending through the first elongated slot, with the second end of the first anti-rotation bar extending through the second elongated slot, with the first end of the second anti-rotation bar extending through the third elongated slot, with the second end of the second anti-rotation bar extending through the fourth elongated slot, with the first anti-rotation bar being secured to the first gear boxes of the front set of spirals, and with the second anti-rotation bar being secured to the second gear boxes of the rear set of spirals; wherein the improvement further comprises an improved paper guide comprising, in combination: means for abutting with and aligning the web of paper; and means for adjustably mounting the abutting and aligning means to the second anti-rotation bar; and wherein the improvement further comprises improved spirals comprising, in combination: a hollow tube having a first end and a second end, with the hollow tube being in gearing relation with the spiral shafts by the first and second gear boxes; an elongated bolt having a head and a shank; a hub including the spiral blades, with the shank of the elongated bolt being threaded into the hub, with the shank of the elongated bolt extending through the hollow tube, with the hollow tube being capturable between the head of the elongated bolt and the hub for rotatably relating the spiral blades with the hollow tube wherein the rotatable orientation of the spiral blades can be adjusted by loosening the elongated bolt, turning the hub with respect to the hollow tube, and retightening the elongated bolt for rotatably relating the spiral blades to the hollow tube.

2. The folder unit of claim 1 wherein the abutting and aligning means comprises, in combination: a C-shaped member including a first leg having a first end and a second end, a second leg having a first end connected to the second end of the first leg and having a second end, and a third leg having a first end connected to the second end of the second leg and having a second end.

3. The folder unit of claim 2 wherein the adjustably mounting means comprises, in combination: a first block member; a second block member; means for removably securing the first and second members together for capturing the second anti-rotation bar therebetween allowing the first and second block members to be slid and/or rotated on the anti-rotation bar without removing the first and second members from the anti-rotation bar; and means for securing the first end of the first leg to the first member.

4. The folder unit of claim 1 wherein the sliding means comprises, in combination: a yoke; a plate in a stationary position with respect to the first drive gear, with the plate including a slot elongated in a direction parallel to the third shaft; and a shifting bolt extending through the elongated slot and threadably engaged in the yoke, wherein when the bolt is in a loosened condition, the bolt is free to travel in the elongated slot for sliding the yoke along the drive shaft due to its threaded relation and wherein in a tightened relation, the bolt prevents relative movement between the plate and the yoke; a pinion gear carried by the shifting bolt; a rack gear secured to the plate in gearing relation with the pinion gear, wherein when the bolt is in a loosened condition, rotation of the pinion gear causes the bolt to move within the elongated slot due to the gearing relation of the pinion gear and the rack gear allowing fine adjustment of the position of the second drive gear on the third drive shaft and thus the fine adjustment of the rotatable position of the front and rear sets of spirals with the position of the paper chute.

5. The folder unit of claim 4 further comprising an improved yoke comprising, in combination: a block having an upper face, a lower face, an inner face, an outer face, a first end, and a second end; a concave removed portion formed in the block extending into the upper face and the inner face and located between the first and second ends, with the concave removed portion having a shape and size complementary to and for receipt of the second drive gear; a first leg defined between the first end and the concave removed portion; a second leg defined between the second end and the concave removed portion; and means for rotatably and slideably mounting the shaft to the first and second legs and for abutting with and sliding the second drive gear on the third drive shaft.

6. The folder unit of claim 1 further including means for kicking the paper onto the spiral in rotatable relation with the first and second shafts, the improvement comprising improved kicking means comprising, in combination: a first member; a second member; means for removably attaching the first member to the second member with the shaft captured therebetween; bristles extending from at least one of the first and second members around 180 degrees of the periphery of the shaft defining a diameter edge of the bristles, wherein the diameter edge of the bristles can be rotatably positioned on the shafts to be parallel to the chute when the chute is located midway between the first and second positions.

7. In a folder unit for folding a continuous web of paper having cross perforations including a front set of spirals driven by a first shaft having a first end and a second end, a rear set of spirals driven by a second shaft having a first end and a second end, with the first shaft being in a parallel spaced relation to the second shaft, a paper chute pivotal between a first position for directing the paper web towards the front set of spirals and a second position for directing the paper web towards the second set of spirals and a first drive gear in a rotatable relation with the position of the paper chute, wherein the improvement comprises means for driving the first and second shafts together and for allowing the simultaneous phase shifting of the first and second shafts with the position of the paper chute, with the phase shifting and driving means comprising, in combination: a third drive shaft extending between the first and second shafts; means for rotatably relating the third drive shaft and the first shaft; means for rotatably relating the third drive shaft and the second shaft; a second drive gear rotatably related to but slideable with respect to the third drive shaft; with the first and second drive gears being helical gears and in gearing relation together; and means for sliding the second drive gear with respect to the third drive shaft forcing the third drive shaft to rotate and change its rotational position with respect to the first drive gear due to the helix of the first and second helical drive gears causing the rotational position of the front and rear sets of spirals to simultaneously change with respect to the position of the paper chute due to the rotatably relating means of the third drive shaft with the first and second shafts.

8. The folder unit of claim 7 wherein the sliding means comprises, in combination: a yoke; and means for shifting the yoke with respect to the first drive gear.

9. The folder unit of claim 8 wherein the shifting means comprises, in combination: a plate in a stationary position with respect to the first drive gear, with the plate including a slot elongated in a direction parallel to the third shaft; and a shifting bolt extending through the elongated slot and threadably engaged in the yoke, wherein when the bolt is in a loosened condition, the bolt is free to travel in the elongated slot for sliding the yoke along the drive shaft due to its threaded relation and wherein in a tightened relation, the bolt prevents relative movement between the plate and the yoke.

10. The folder unit of claim 9 further comprising, in combination: a pinion gear carried by the shifting bolt; a rack gear secured to the plate in gearing relation with the pinion gear, wherein when the bolt is in a loosened condition, rotation of the pinion gear causes the bolt to move within the elongated slot due to the gearing relation of the pinion gear and the rack gear allowing fine adjustment of the position of the second drive gear on the third drive shaft and thus the fine adjustment of the rotatable position of the front and rear sets of spirals with the position of the paper chute.

11. The folder unit of claim 8 further comprising an improved yoke comprising, in combination: a block having an upper face, a lower face, an inner face, an outer face, a first end, and a second end; a concave removed portion formed in the block extending into the upper face and the inner face and located between the first and second ends, with the concave removed portion having a shape and size complementary to and for receipt of the second drive gear; a first leg defined between the first end and the concave removed portion; a second leg defined between the second end and the concave removed portion; and means for rotatably and slideably mounting the shaft to the first and second legs and for abutting with and sliding the second drive gear on the third drive shaft.

12. The folder unit of claim 7 further including first and second side plates, with the first end of the first shaft extending through a first elongated slot formed in the first side plate and with the second end of the first shaft extending through a second elongated slot formed in the second side plate, with the first end of the second shaft extending through a third elongated slot formed in the first side plate and the second end of the second shaft extending through a fourth elongated slot formed in the second side plate, wherein the improvement further comprises means for changing the spacing between the first and second shafts, with the spacing changing means comprising, in combination: a first slide bar secured to the first side plate beneath and generally parallel to the first and third elongated slots; a second slide bar secured to the second side plate beneath and generally parallel to the second and fourth elongated slots; first means for rotatably supporting the first end of the first shaft, with the first means having a bottom surface for sliding on the first slide bar; second means for rotatably mounting the second end of the first shaft, with the second means having a bottom surface for sliding on the second slide bar; third means for rotatably mounting the first end of the second shaft, with the third means having a bottom surface for sliding on the first slide bar; and fourth means for rotatably mounting the second end of the second shaft, with the fourth means having a bottom surface for sliding on the second slide bar, wherein the first and second shafts are supported by the rotatably mounting means slideably supported on the first and second slide bars and not by the elongated slots allowing the elongated slot to be of the clearance variety and not milled in the side plates reducing the manufacturing costs of the side plates and the overall folder unit.

13. The folder unit of claim 12 wherein the first rotatably mounting means includes the means for rotatably relating the third drive shaft and the first shaft; and wherein the third rotatably mounting means includes the means for rotatably relating the third drive shaft and the second shaft, with the first and third rotatably mounting means comprising gear boxes.

14. The folder unit of claim 7 further including means for kicking the paper onto the spiral in rotatable relation with the first and second shafts, the improvement comprising improved kicking means comprising, in combination: a first member; a second member; means for removably attaching the first member to the second member with the shaft captured therebetween; bristles extending from at least one of the first and second members around 180 degrees of the periphery of the shaft defining a diameter edge of the bristles, wherein the diameter edge of the bristles can be rotatably positioned on the shafts to be parallel to the chute when the chute is located midway between the first and second positions.

15. The folder unit of claim 7 wherein the improvement further comprises an improved means for preventing the spirals from rotating with the first and second shafts comprising, in combination: a first anti-rotation bar having a first end and a second end; a second anti-rotation bar having a first end and a second end, with the first and second anti-rotation bars being in a spaced, parallel relation to each other and the first and second shafts, with the first and second anti-rotation bars and the first and second shafts lying in a single plane, with the spirals being driven by the shafts by gearboxes, with the first end of the first anti-rotation bar extending through the first elongated slot, with the second end of the first anti-rotation bar extending through the second elongated slot, with the first end of the second anti-rotation bar extending through the third elongated slot, with the second end of the second anti-rotation bar extending through the fourth elongated slot, with the first anti-rotation bar being secured to the gear boxes of the front set of spirals, and with the second anti-rotation bar being secured to the gear boxes of the rear set of spirals.

16. The folder unit of claim 15 wherein the improvement further comprises an improved paper guide comprising, in combination: a C-shaped member including a first leg having a first end and a second end, a second leg having a first end connected to the second end of the first leg and a second end, and a third leg having a first end connected to the second end of the second leg and having a second end; and means for connecting the first end of the first leg to the anti-rotation bar.

17. The folder unit of claim 16 wherein the means for connecting the first end of the first leg to the anti-rotation bar comprises, in combination: a first block member; a second block member; means for removably securing the first and second members together for capturing the second anti-rotation bar therebetween allowing the first and second block members to be slid and/or rotated on the anti-rotation bar without removing the first and second members from the anti-rotation bar; and means for securing the first end of the first leg to the first member.

18. The folder unit of claim 12 wherein the spiral gear boxes include an aperture for the sliding receipt of the anti-rotation bars; and means for locking the anti-rotation bar within the aperture of the spiral gear boxes.

19. The folder unit of claim 7 further comprising improved spirals comprising, in combination: a hollow tube having a first end and a second end, with the hollow tube being in gearing relation with the spiral shafts; an elongated bolt having a head and a shank; a hub including the spiral blades, with the shank of the elongated bolt being threaded into the hub, with the shank of the elongated bolt extending through the hollow tube, with the hollow tube being capturable between the head of the elongated bolt and the hub for rotatably relating the spiral blades with the hollow tube wherein the rotatable orientation of the spiral blades can be adjusted by loosening the elongated bolt, turning the hub with respect to the hollow tube, and retightening the elongated bolt for rotatably relating the spiral blades to the hollow tube.

* * * * *